United States Patent [19]

Roberts

[11] 4,017,074

[45] Apr. 12, 1977

[54] TABLE BASEBALL GAME

[76] Inventor: Goodwin N. Roberts, 17 W. 174 Deerpath Road, Bensenville, Ill. 60106

[22] Filed: June 23, 1975

[21] Appl. No.: 589,331

[52] U.S. Cl. ..... 273/89; 273/126 R; 273/128 R; 273/129 R

[51] Int. Cl.[2] ..... A63F 7/06

[58] Field of Search ..... 273/89, 90, 126 R, 126 A, 273/129, 128 R

[56] References Cited

UNITED STATES PATENTS

| | | | |
|---|---|---|---|
| 487,825 | 12/1892 | Curtis et al. | 273/89 |
| 961,714 | 6/1910 | Chase | 273/89 |
| 1,008,898 | 11/1911 | Fulton et al. | 273/89 |
| 1,013,074 | 12/1911 | Schutz | 273/128 R |
| 1,126,980 | 2/1915 | Glass | 273/126 R |
| 1,157,913 | 10/1915 | Twibell | 273/89 |
| 1,296,882 | 3/1919 | Vance | 273/89 |
| 1,381,563 | 6/1921 | Kaufman | 273/89 |
| 1,642,093 | 9/1927 | Stewart | 273/89 |
| 2,053,170 | 9/1936 | Wood | 273/89 |
| 2,478,429 | 8/1949 | Sinclair | 273/89 |
| 2,775,457 | 12/1956 | Galbos | 273/89 |
| 3,785,652 | 1/1974 | Ghouanloo | 273/129 E X |

FOREIGN PATENTS OR APPLICATIONS

| | | | |
|---|---|---|---|
| 293,261 | 7/1928 | United Kingdom | 273/126 R |
| 7,697 | 4/1902 | United Kingdom | 273/126 R |

*Primary Examiner*—Paul E. Shapiro
*Attorney, Agent, or Firm*—Fitch, Even, Tabin & Luedeka

[57] ABSTRACT

A game board construction for a simulated baseball game wherein the pitching is controlled by one player and the batting is controlled by another player. The bat is elastically biased and is disposed adjacent home plate, the baseball is in the form of a disc having a flat surface adapted to slide on the playing surface of the board, and the pitching unit is in center field and is arranged to drive the disc on the playing surface toward the bat. A plurality of fielder units are distributed over the playing field to be struck by batted discs, and there are designated areas at various locations on the playing field, each setting forth a play that occurred when a batted baseball comes to rest within its boundary.

8 Claims, 12 Drawing Figures

TABLE BASEBALL GAME

The present invention relates to new and useful improvements in games and more particularly to a table type baseball game apparatus providing action for and requiring skill of the players.

Although many different types of toy apparatus for playing baseball, or something more or less akin thereto, in miniature, have been proposed and used, these generally have failed to provide features which would result in the general acceptance and demand by the general public. It is believed that the reason for this failure to obtain popularity is that the prior games have not provided features capable of gaining a sustained interest by the users. Preferably, such apparatus should possess characteristics that create in the users thereof some of the enthusiasm and excitement of participants in or spectators at an actual baseball game, even though it be only of the sandlot type.

It is an important objective of the present invention to provide baseball game apparatus that is definitely an action game that simulates actual baseball playing in all of its phases and requires skill of the players with the luck factor reduced to a minimum.

This and other objects of the present invention are more particularly set forth in the following detailed description and in the accompanying drawings of which:

Figures 1, 2:
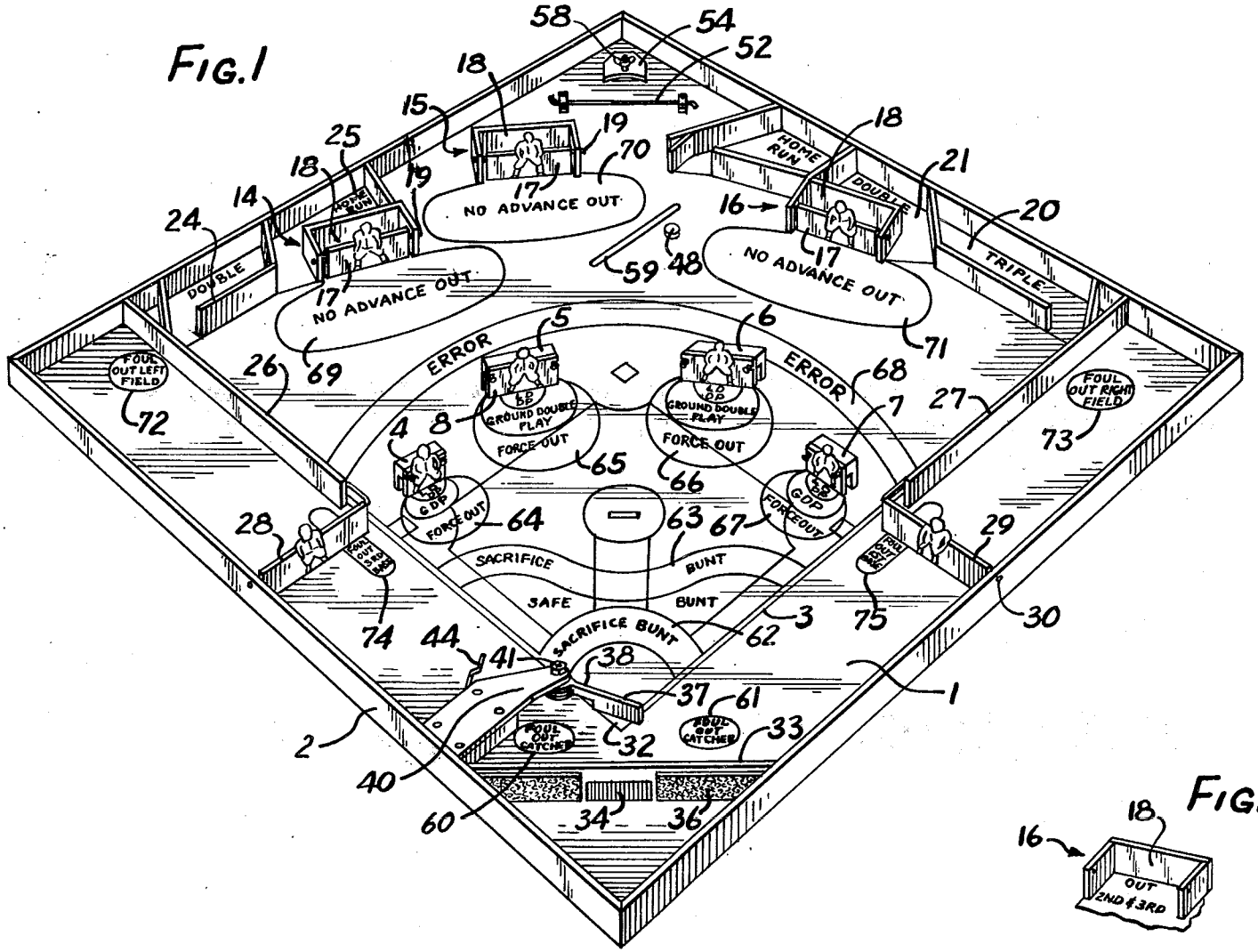
FIG. 1 is a perspective view of a game board apparatus made in accordance with the principles of the present invention.
FIG. 2 is a perspective view of a portion of a fielder unit for use in the apparatus of FIG. 1.

Briefly, the miniature table baseball game apparatus described herein provides a skill game with the luck factor usually associated with board games reduced to a minimum. It is definitely an action game designed to simulate real-life baseball in all of its principal phases. It features actual pitching and batting between two or more players, with ensuing hits, outs, walks, strikeouts, runs, errors, double plays, force outs, foul balls, and the like occurring in realistic fashion. Because of the abundance of skill, tension, strategy, and competitive spirit developed, and because of its realism, it is believed that the game apparatus of the present invention will have an immediate and sustained appeal to all sport enthusiasts, old and young alike.

The preferred embodiment of the present invention is approximately 30 inches square, or card table size, and is entirely enclosed around the outer edge with a vertical strip. The board has a substantially flat upper playing surface with a simulated baseball diamond thereon laid out in appropriate colors. Infielder units and outfielder units are located in their proper places respectively and are each constructed to provide certain mechanical results in the process of play as explained in detail hereinafter. The pitching and batting operations are both semi-mechanical. The pitching is done from the extreme center field corner of the board, and the batting is done at the opposite or home plate corner. The practice of pitching from the center field corner of the playing field is, of course, not consistent with real baseball, but is preferred in the present instance for several reasons. First and foremost is the provision of a pitching distance great enough to afford the batter sufficient time to judge the speed and direction of the pitch with a fair degree of accuracy. Secondly, if the pitching were done from the conventional position in the center of the infield, the player doing the pitching would have to assume an awkward stance of bending over the game board and in addition would screen much of the playing surface from the batter with his hands and arms. Thirdly, the pitching unit would often interfere with the batted ball and so detract from the game's efficiency.

As will be understood from the following description, the illustrated game is essentially two-dimensional. When the ball is pitched, it does not leave the surface of the board, but rather slides smoothly along the playing surface toward the batter. Also, when the batter hits the ball, it travels back along the playing surface, although it may go in almost any horizontal direction from the batting point. The ball used in this game is not spherical in shape, but rather is disc-shaped and is adapted to slide on one of its faces somewhat like the puck in the game of hockey.

Along the outfield walls at strategic locations are provided five pockets or traps into each of which it is possible for the batter to hit the ball. A ball hit into any one of these pockets counts for an extra base hit, the specific type depending upon the particular pocket hit. There are two "double" pockets, one "triple" pocket, and two "home-run" pockets. At the home-plate corner of the field is constructed another pocket which may be termed the catching pocket. This pocket has a wide-mouthed opening facing the pitcher and simulates the area normally covered by the catcher in real baseball. Almost all pitches which are not hit by the batter enter this pocket. Whether a pitch is a strike or a ball is mechanically determined by means of a thin metal striker plate which hangs on a hinge arrangement directly behind the home plate and in front of the catching pocket.

A number of designated areas are marked off at various locations on the playing surface. When the batted ball comes to rest in any one of these areas, a certain specific play or penalty results in accordance with rules of play which may be established for the game. It should be noted that all apparatus extends from the top surface of the board, there being no extensions of any kind under the undersurface.

More specifically, and with reference to FIG. 1, there is shown a flat board 1 preferably about 30 inches square which will fit on a card table. Of course, if may be used on any other surface, including a floor. Any suitable material may be used for the board 1, such as plywood, composition board, plastic, and the like. Preferably, the board is not more than quarter of an inch thick and is of little weight. A ledge 2 rises above the playing surface of the board along the edges of the board. This ledge may be conveniently provided by securing separate strips about a quarter of an inch thick and about one and three-quarter inches wide to the edge faces of the board, the lower edges of the strips being flush with the underface of the board. Alternatively, the entire board may be molded as one piece. A baseball playing field is laid out on the playing surface of the board with its axis along one of the diagonals of the board. The playing field includes a diamond 3 with its typical four bases, pitcher's mound, etc.

Figure 11:
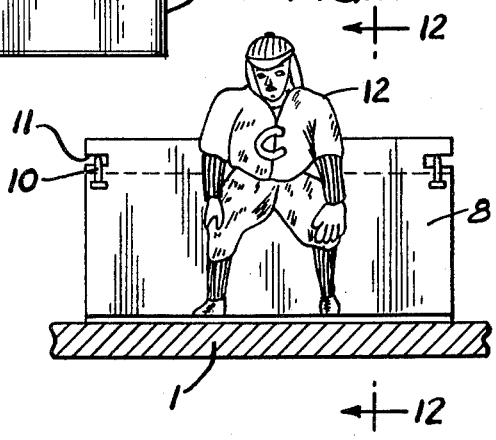
FIG. 11 is a front view in an enlarged scale of a fielder unit for use with the apparatus of FIG. 1.
Figure 12:
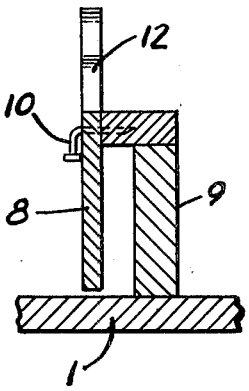
FIG. 12 is a sectional view of the fielder unit taken along the line 12—12 of FIG. 11.

Players, with the exception of a pitcher and a catcher, are placed at about the usual playing positions of such players, and two additional players are positioned in foul territory near first and third bases. There are four infield player units, 4, 5, 6 and 7, which may all be alike, each comprising a small, flat upright gate or panel 8, as best shown in FIGS. 11 and 12, hinged to a sturdy support 9 fixed to and rising from the board behind the same for limited swinging movements about a horizontal axis. The hinges may be simple rods or nails 10 passing through notches 11 in the ends of the panel and into the support, the headed ends of the free ends of the rods being bent down in front of the panel. Each panel may carry the figure of a player 12, whose head and shoulders project up above the same. The length of the panel is preferably much greater than the width of the player.

The panel 8 serves an important function in the operation of the game. In accordance with the rules that may be established for the game, it should be known whether or not a batted ball has actually touched any infielder unit in passing to the outfield, and the freely hung panel serves as an appropriate indicator. Further, the operation of the game requires that the ball come to rest quickly after striking any infielder squarely, because certain areas in the infield are marked off and the ball coming to rest touching any one of these areas constitutes a certain predetermined play. Hence, the other main function of the panel 11 is to absorb the greater part of the momentum of the batted ball and cause it to come to rest in the infield area. Thus, the batted ball will rebound from the panel 8.

There are three outfielder units, 14, 15, and 16 which may all be alike, but the outfielder units differ somewhat from the infielder units. Thus, each outfielder unit comprises a vertical gate or panel 17, similar to panels 8, each panel forming the front wall of a four sided rectangular pocket 18 the other sides of which are fixed to and rise from the board. Panels 17 are positioned between and pivoted, as at 19, to the two sides of the corresponding pockets so as to be able to turn completely over or, at least, to swing up until they lie about parallel to the board.

The outfielder panels 17 also serve an important function in the operation of the game. Unlike the function of the infielder panels 8, which is to repel the ball back a short distance toward the batter, the outfielder unit with its panel 17 is constructed to actually retain or catch the ball most of the time. This maneuver corresponds to a real outfielder's catching of a fly ball. The ball hitting the outfielder gate 17 causes it to revolve back and over on its pivots and then down again to its neutral position, thus preventing the ball from deflecting back out of the outfielder pocket. Occasionally, however, the ball is not held and slips back out onto the playing field, and as described hereinafter, there is a designated area in the region of the player unit that indicates a resulting play when the ball comes to rest within the bounds of the designated area.

Behind the right fielder unit are three pockets 20, 21, and 22, extending in that order from the foul line to the vicinity of center field, these pockets having openings or inlets facing the diamond. Behind the left fielder unit are two pockets 24 and 25 that may be of similar construction to pockets 20 and 21 on the other side of the field and be similarly placed with respect to the left field foul line as are the latter with respect to the right field foul line. No third pocket is used inside the left field foul line so that, when the center fielder unit is placed to the left of center, a free space is provided for the passage of a pitched ball along the main axis from remote center field. These pockets are the extra base pockets and are simply walled-off sections along the two outfield main walls. Each has a narrow opening facing the home plate through which it is possible to bat the ball. It will be noted that these five pockets are irregularly shaped and are constructed to prevent the ball from rebounding out again once it has entered the pocket. The pockets 21 and 24 represents two-base hits, the pocket 20 represents a three-base hit, and the pockets 22 and 25 represent home-runs. These pockets respectively are strategically located to simulate the approximate areas in real baseball game where such hits normally would occur. It can be seen that the opening area is substantially smaller than the entire area of the pocket. The purpose of the limited opening is to bring the percentage of extra base hits when compared to singles within a reasonably close approximation of that which occurs in a real baseball game.

Figure 7:
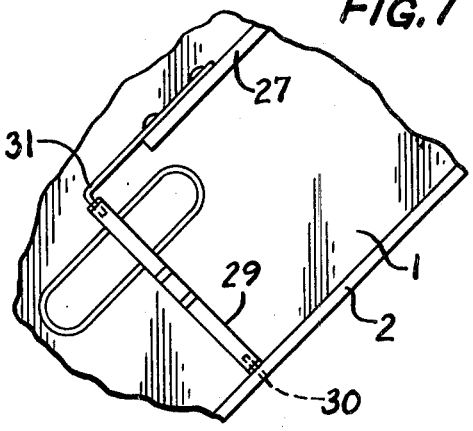
FIG. 7 is a top plan view on a larger scale of a portion of the board of FIG. 1 illustrating apparatus for use in foul ball territory thereon.

Barriers 26 and 27 extend along the outfield sections of the foul lines from third and first bases. Gates 28 and 29, similar to gates 17, extend from the infield ends of these barriers to the border ledge or flange of the board, thereby forming a long, rectangular enclosure or pocket along the outfield portion of each foul line. Each of these gates is mounted to swing freely about a horizontal axis. Thus, as shown in FIG. 7, the gates may be supported on stationary pivot pins 30 and 31 that enter their vertical edges, as is the case with gates 17. Any batted ball which is not hit in fair territory must hit one of the foul ball gates and cause it to swing. Such swinging indicates to the players that the ball was definitely foul. These gates not only serve as indicators but also have another important function. Since the ball must expend a good part of its energy upon striking the gates, it comes to rest soon after passing under them and, in fact, may even be repelled slightly backward toward the bat before stopping. This behavior permits the logical use of certain areas marked in the foul ball section, both in front of and in back of these gates. If a batted ball comes to rest on any of these designated areas, a predetermined play results in accordance with the indicia on the areas.

Behind home plate 32 is a catching unit which is simply a corner of the board walled off in a novel way. The rigid part of the wall is a bar 33 extending between the border ledges meeting at that corner, at a substantial distance above the board, the bat being at right angles to the axis of the playing field. A thin rectangular striking plate 34, positioned in front of the bar, is suspended therefrom by suitable hinge means 35 that permit it to swing back under the bar. The inside of the pocket is lined with felt 36 or other cushioning material, except in the space spanned by the striker plate. This lining forms yielding wall sections below the bar at each side of the striker plate. The striker plate preferably is a thin rectangular metal plate. Thus, whether a pitch is a strike or a ball can be mechanically determined, since if the plate moves and emits a sharp "ping" sound as the ball enters the catching unit, the pitch is obviously a strike. To the contrary, if this motion and sound does not occur, the pitch is just as obviously a ball.

Figure 6:
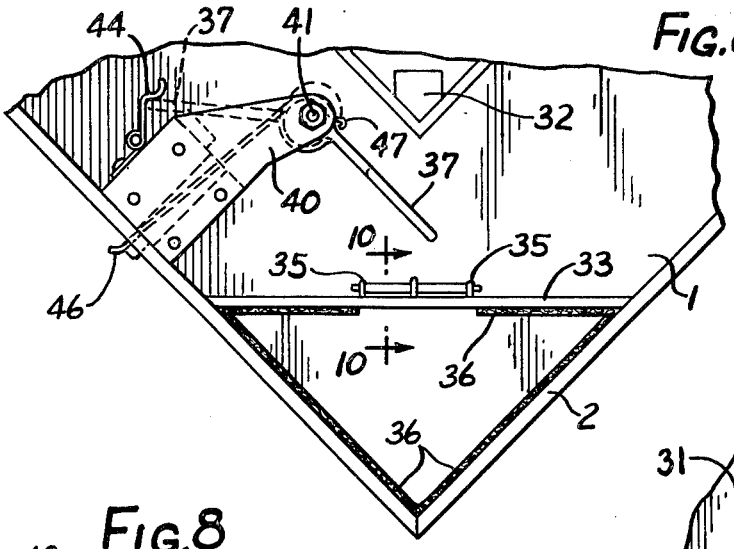
FIG. 6 is a top plan view on a larger scale of another portion of the board of FIG. 1 illustrating a batting unit and a catching unit for use thereon.
Figure 8:
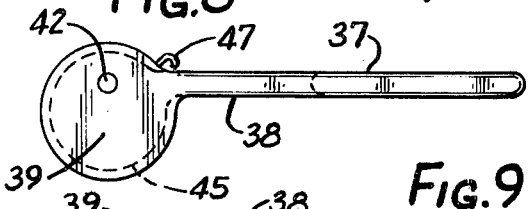
FIG. 8 is a top plan view of a bat for use with the batting unit of FIG. 6.
Figure 9:
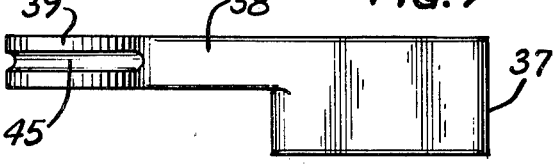
FIG. 9 is a rear view in elevation of the bat of FIG. 8.
Figure 10:
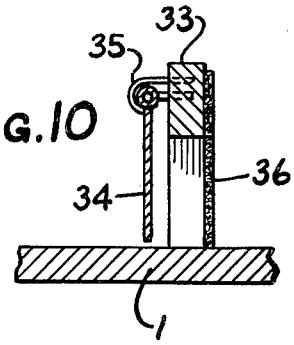
FIG. 10 is a sectional view on an enlarged scale of a portion of the catching unit taken along the line 10—10 of FIG. 6.

The preferred bat that forms a part of the game as best seen in FIGS. 8 and 9 includes a paddle 37 at the end of a stem 38 that merges into a disc-like hub 39. The plane of the hub is at right angles to the plane of the paddle, and the stem is substantially tangential to the hub. Referring now to FIG. 6, where the entire batting unit is shown, the bat is attached to a fixed support 40 in front of the left side of bar 33, so as to lie close to the board, by a connecting means, such as a bolt 41, that passes loosely through an eccentric hole 42 in the hub. The hole 42 is on the center line of the stem and paddle. The parts are so proportioned that the bat may rotate through an angle of about 300° from a position in which the paddle is behind home plate as in FIG. 6, to the idle position shown in broken lines in that figure. During such movement, the paddle 37 passes over home plate, as shown in FIG. 1. A latch 44 is provided to engage the free end of the bat when the latter reaches its idle position. The hub element of the bat contains circumferential groove 45 to provide a seat for an elastic member 46, which may be an elastic band, spring, or the like, that provides the power to drive the bat. One end of the elastic member is connected to a hook 47 on the hub, near the adjacent end of the stem element of the bat, while the other end of the elastic member is anchored to the ledge bordering the board. The parts are so proportioned and disposed that the radius of the hub, at the point where the elastic member meets the hub, is smallest when the bat is in the idle position and increases progressively as the bat is rotated by a player toward its batting position. Such rotation causes the tension of the elastic member to increase at an accelerated rate as the bat moves toward the batting position.

When a batter is "up", the bat is unlatched from the latch 44 and swung around as far as desired to await an oncoming pitch. It may be held stationary by a player to await an oncoming ball or it may be released to strike a swinging blow with more or less force. The player's skill will determine whether the bat should be stationary or be moving slowly or rapidly at the moment of impact with the ball, and the player's timing of swing will determine the angle of the bat at that moment of impact with the ball to drive the ball in a desired direction, as in an actual baseball game. A player must develop a good sense of timing and the ability to refrain from swinging at pitches not over the plate in order to become proficient at batting. In this connection, the stem 38 is sufficiently high above the playing board to allow the baseball when sliding on the surface to move thereunder when the paddle 37 misses the ball during a swing or the ball is otherwise so directed.

Instead of a spherical baseball, a sliding member in the form of a thick disc 48 having a circumferential V-groove 49 extending in the edge surface around the same is used. In the preferred embodiment, a disc having a diameter of about five eighths of an inch and a thickness of about one quarter of an inch is used. The disc may conveniently be made of hard wood and contain a central plug 50 of lead or other suitable metal to provide some weight. The underside of the disc is faced with a layer 51 of felt or the like. A baseball of this kind can be caused to perform in a very interesting manner. Materials other than wood also could be utilized for the construction of the disc. Preferably, the ball is of a light color so as to stand out on the playing board.

The baseball is "pitched" by a unique pitching unit out beyond center field. The reason for placing the center fielder a little to the left of the axis, as mentioned previously, is to leave a clear space along the axis of the playing field for the sliding travel of the pitched baseball toward home plate. The immediate "pitching" device is an elastic member 52 which may be an elastic band, spring, or the like, anchored at its ends to the board so as to extend at right angles to the axis of the playing field, with such axis intersecting the elastic member 52 at the middle of the latter. On the board, well behind the elastic member, is a wide stop plate 54 having a front edge 55 that preferably is concave and forms an arc of a circle of considerable radius having its center on the axis of the playing field. The stop plate is preferably adjustable away from and toward the elastic member 52. In the arrangement shown, the stop plate contains a central slot 56, the longitudinal center of which is in register with the axis of the playing field and bisects elastic member 52, and a screw post 57, fixed to the board, passes up through the slot. A wing nut 58 on the post serves to clamp the plate to the board in any position into which the plate may be adjusted.

When the baseball is to be pitched, it is set on the board in front of the elastic member 52, with the elastic member entered into the circumferential groove therein. The baseball is drawn back to or toward the stop plate by a player to place the elastic member under tension and, upon release of the ball by the player, the baseball is shot forward in the manner of an arrow from a bow. The baseball may be moved back to stress the elastic member by means of a fingertip placed on same, but it is then preferably held in place, until it is pitched, by a little rod 59 provided with rounded ends. Such a rod is shown lying on the board in FIG. 1. The reason for using the rod is that grease from the fingers makes the face of the ball sticky, and the ball otherwise tends to adhere to the fingertip and prevent a quick sharp release of the ball in pitching.

In the preferred embodiment, the two anchoring posts for the elastic member 52 are placed five inches apart and are so located that the axis of the board on the principal diagonal falls midway between them and is perpendicular to the cross-connected elastic member. The primary purpose of the stop plate 54 is to provide a limitation on the speed of the pitched ball, since the batter must have sufficient time after the ball has been released for his normal reflexes to permit him to swing at it. For this reason the described stop device is provided to limit the backward distance through which the ball may be drawn and yet which is adjustable to permit a variance of the maximum speed setting according to the players' discretion.

In order that all plays shall be discernible as in an actual game, various designated areas of the playing field are marked to set them apart, and legends or indicia are placed in association with such areas and with the pockets heretofore described. Behind home plate, to the left and right, are small areas 60 and 61, respectively, each bearing the legend "Foul Out Catcher". A short distance in front of home plate is an arc-shaped band 62, while nearer the pitcher's mound is a band 63 having an undulated shape, both marked "Sacrifice Bunt". The space between these bands is marked "Safe Bunt". Immediately adjacent in front of each infielder is a group of three nested areas, the large outer areas 64, 65, 66 and 67 being marked "Force Out"; the areas of intermediate size being marked "Ground Double Play" or the abbreviation "G.D.P."; and the innermost areas being marked "L.O.—D.P.", meaning that the batter has lined out and a double play has resulted. Behind the infield positions is an arc-shaped band 68 extending from foul line to foul line marked "Error". Immediately adjacent in front of each outfielder is an oval area, these being 69, 70 and 71, respectively, and being marked "No Advance Out". In the pockets 18, immediately behind the outfielders, are legends to indicate that the batter is out and that one or more base runners have advanced. Thus, as shown in FIG. 2, the right fielder pocket has in the bottom the indicia "Out" and the expression "2nd and 3rd Adv." In each of pockets 21 and 24 is the indicia "Double"; in pocket 20 is the indicia "Triple" and in each of pockets 22 and 25 is the indicia "Home Run". In pockets 26 and 27 are small areas, 72 and 73, that are respectively marked "Foul Out Left Field" and "Foul Out Right Field". Two other small areas 74 and 75 are marked off adjacent the swinging gates or panels 28 and 29, respectively, and marked to indicate that a better has fouled out when the baseball comes to rest in either of these areas.

Anyone interested in baseball will understand in a general way the manner of using this game apparatus, without further explanation, but a few things may not be immediately apparent and are described hereinafter.

Figure 3:
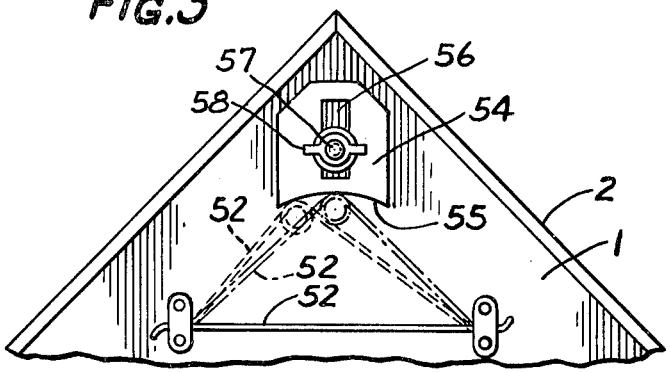
FIG. 3 is a top plan view on an enlarged scale of a portion of the board of FIG. 1 illustrating a pitching unit for use thereon.
Figure 4:
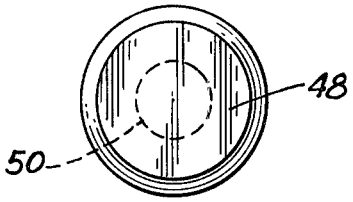
FIG. 4 is a top plan view of a baseball for use in combination with the apparatus of FIG. 1.
Figure 5:
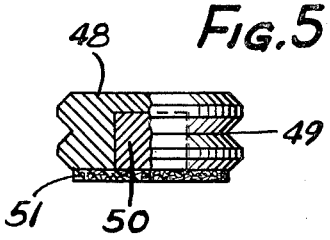
FIG. 5 is a view, partly in side elevation and partly in section, of the baseball of FIG. 4.

The ball element, though a disc instead of a sphere, reproduces more nearly than is otherwise possible in two-dimensional, as distinguished from three-dimensional play, the performance of an actual baseball. The ball may be pitched at any desired speed, the stop plate 54 setting the maximum limit. Obviously, the farther back the stop plate 54 is, the greater will be the tension of the elastic member 52 when the ball touches the stop. Right hand side arm pitching can be simulated by drawing the ball back to the left hand end of the curved edge 55 of the stop plate as in one of the two broken line positions shown in FIG. 3. If the ball is started from the other end of the arc-shaped edge of the stop plate, the direction of the pitch corresponds to a side arm left-handed pitch. Another important feature is that the ball may be given a twist for throwing a curve. Thus, after the ball has been drawn back by a fingertip into engagement with the stop plate, the ball may be rolled laterally along the edge of the stop plate and, because the elastic member 52 is wedged more or less into the V-groove in the ball, the tension in the portion of the elastic member on one side of the ball lessens while that on the other side increases. Then, after the rod 59 has been substituted for the finger and is quickly lifted, the ball is not only hurled toward the batter, but is given a quick turning movement as the tension in the elastic member equalizes.

If the batter misses the pitched ball, it is, of course, a strike. However, if he does not attempt to hit the ball, the question of whether a strike or a ball should be called is automatically determined. The stem element 38 of the bat is far enough above the board to allow an "inside" pitched ball to pass under the same and be registered as a ball. If a pitch actually was a strike, the "ping" of the ball hitting the striker plate 34 announces this fact. If there is no "ping", it means that the ball has passed on one side or the other of the striker plate under the felt and into the catcher pocket, the pitch, therefore, having been wide of the home plate. In this connection it should be noted that the distance from the lower edge of the striker plate to the face of the board is less than the thickness of the ball, so that although the ball can easily enter the pocket, it must give an audible indication thereof. Furthermore, while the felt beside the striker plate may extend farther down than the lower edge of the striker plate, it is sufficiently yieldable to permit the ball to push it back for entry into the pocket underneath the same. After the ball enters the pocket, and strikes the felt lining at the back, it loses its momentum and does not bounce back out of the pocket. It may, however, rebound to a point against the striker plate or the loose felt beside it.

When the batter hits the ball it is either a fair ball or a foul, and the batter may be safe or out. The base runners, if any, may be retired by double plays, may be required to remain where they are, or advance, depending on the usual factors that decide these matters in actual baseball play.

Any ball hit into fair territory is a safe hit unless it comes to rest in an area or pocket that calls the batter out or in an unmarked infield area. The batter may be safe on an error if the ball stops in the "Error" zone. A hit is a single unless it ends up in an extra base pocket that makes it a double, triple or a home run. Fouls do not result in outs unless the ball comes to rest in one of the designated areas that are so marked.

The swinging gates or panels on the outfielder pockets serve to separate long flies from short flies. When a ball hits one of these gates hard enough to drive back into the pocket behind the gate, it is a long fly. If the blow be so feeble that the ball bounces off the gate, it is a short fly. In order that a short may be considered caught, the ball must come to rest within the boundary of the designated area marked off directly in front of the pocket.

Anything that hits an infielder and remains in the infield is an out, unless the ball comes to rest in a designated area bearing indicia to the contrary. The legends in the three nested areas in the region immediately adjacent each infielder denote frequently recurring plays where an infielder makes or assists in making an out on a batted ball. By employing infielders in the form of yieldable panels, the force of a blow struck by the ball against an infielder is so dampened that a ball, which might otherwise rebound to the home plate or farther, may come to rest in one of the corresponding three nested areas in the region of the same or in some other area within the infield.

Bunting is accomplished by maintaining finger contact on the bat to control the rotation of the bat over the plate to meet the pitched ball with only sufficient force to move the ball a short distance into the infield.

A batter may "step out of the box" before a pitch by merely placing his free hand across the home plate, thus forcing the pitcher to begin his delivery all over again. Experience has shown that preferably certain clearly defined rules governing the pitching operation should be laid down and closely adhered to. In a real baseball game, once the pitcher has begun his wind-up, he must continue through to the actual delivery of the ball in one steady motion. If he hesitates in his delivery, or if he fails to have his foot on the "rubber" at the start, a balk is called, and any runners advance a base. There is also an official rule which prevents a pitcher from taking a ball from his catcher and firing it back before the batter has had reasonable opportunity to adjust himself after the previous pitch.

As the pitcher places the ball against the elastic member and draws it back, it is preferred that he be allowed to use only the tips of a thumb and one finger, or of two fingers alone, and he should have his hand and remaining fingers above and away from the ball and from the elastic member in order to afford the batter as much vision as possible. In drawing the ball back for the pitch, the actual linear motion may be slow or rapid, in a straight line or an arc, but once this motion has stopped there should be no further backward, sideward, or forward motion permitted, and the pitching rod should be placed on the ball immediately. Twist may also be applied to the ball, either while it is being drawn back or after it has reached the desired position. However, this twist should also be applied in one motion and in one direction, and no further increase or reduction of the twist should be permitted. If the pitcher violates any of these rules, there is no specific penalty, but the batter can force the pitcher to begin his pitch over again by merely stepping out of the box as mentioned previously.

By analogy to actual baseball pitching, the point where the pitching rod is placed on the ball corresponds to the phase of an actual pitching delivery where the pitcher starts to uncoil his body and bring his arm forward. In order to follow through with the actual pitch, the pitcher then shifts his weight from the foot on the slab to the one he has placed forward in a striding motion. He does not, in fact he cannot, let go until all his weight is on the forward foot. In other words, it is impossible for the pitcher to deliver the ball without giving the batter due notice through body and foot motions.

Hence, another important rule which should be followed in this table game pertains to the player's free hand after the pitching rod has been placed on the ball with the other hand. The player's free hand should be moved at a moderate speed and placed on the table alongside of the board. The ball should not be released until after the hand not in use has come to rest. This is particularly important as it prevents any screening of the ball from the batter or any confusing motions, and it also prevents any quick pitches which do not give the batter time to get set. For every violation of this rule an automatic "ball" could be called regardless of the true nature of the pitch. If, however, the batter hits the ball in fair territory, it must go for whatever results and a "ball" should not be called. There is also the other extreme of where the pitcher holds the ball unduly long after his hand has come to rest. In such an instance, no specific rule is needed since the batter merely has to step out of the box and force the pitcher to begin his delivery over again.

Rules, closely paralleling regular baseball rules, can be formulated to govern the actions of the persons acting as pitchers and batters and to cover other phases of the game not definitely determined by the legends on the board.

Summarizing, there has been described baseball game apparatus including a board having a substantially flat upper playing surface with a simulated baseball diamond thereon. An elastically-biased bat is provided adjacent the home plate, and a baseball is provided in the form of a disc having a flat surface adapted to slide on the playing surface of the board. A pitching unit is provided in center field and is arranged to drive the baseball on the playing surface toward the bat. A plurality of fielder units are distributed over the playing field to be struck by the batted baseballs, and there are provided designated areas at various locations on the playing field, including the regions immediately adjacent each of these fielder units. Each of the designated areas have indicia denoting a play assumed to have occured when a batted baseball comes to rest thereon.

While the invention has been described in connection with a preferred embodiment, many alternatives, modifications, and variations may be apparent to those skilled in the art in view of the foregoing description. Accordingly, it is intended to embrace all such alternatives, modifications, and variations as fall within the spirit and scope of the appended claims.

Various features of the invention are set forth in the following claims.

What is claimed is:

1. Baseball game apparatus comprising a board having a substantially flat upper playing surface with a simulated baseball diamond thereon, a bat mounted for turning on said apparatus adjacent home plate by a first player, a baseball in the form of a disc having a V-shaped circumferentially extending groove thereon and a flat surface adapted to slide on the playing surface, a selectively operable pitching means including a rod for engaging said disc in a pitching unit in center field operated by a second player to drive said baseball to slide on the playing surface toward said bat, said pitching means including an elastic band engaging said groove and extensible to propel said disc at different speeds and to impart selectively a spinning action to cause the baseball to partake different and curved paths along said surface and at different speeds, fielder units distributed over the playing field to be struck by batted and sliding baseballs, and designated areas at various locations on the playing field including locations immediately adjacent some of said fielder units denoting a play assumed to have occurred when said sliding baseball after being batted comes to rest thereon.

2. Game apparatus in accordance with claim 1 wherein first ones of the fielder units comprise pockets and swinging front walls to admit the baseballs into the pockets, and second ones of said fielder units comprise yieldable devices to check the movement of the baseballs while permitting them to rebound.

3. Baseball game apparatus comprising a board having a substantially flat upper playing surface with a simulated baseball diamond thereon, a bat mounted for turning on said apparatus adjacent home plate by a first player, a baseball in the form of a disc having a flat surface adapted to slide on the playing surface, a pitching unit in center field operated by a second player to drive said baseball on the playing surface toward said bat, fielder units distributed over the playing field to be struck by batted baseballs, designated areas at various locations on the playing field including locations immediately adjacent some of said fielder units denoting a play assumed to have occurred when said baseball after being batted comes to rest thereon, and a walled catching pocket behind said bat, said pocket having on the side facing the bat a wall yieldable to allow said baseball when sliding along the board and forceably striking said wall to pass under same and enter the pocket, the central section of said wall being of a material that gives a sharp sound when struck by said baseball and the wall sections beside the central section being of a material that gives off little sound when struck by said baseball.

4. Baseball game apparatus comprising a board having a substantially flat upper playing surface with a simulated baseball diamond thereon, a bat mounted for turning on said apparatus adjacent home plate by a first player, a baseball in the form of a disc having a flat surface adapted to slide on the playing surface, a pitching unit in center field operated by a second player to drive said baseball on the playing surface toward said bat, fielder units distributed over the playing field to be struck by batted baseballs, designated areas at various locations on the playing field including locations immediately adjacent some of said fielder units denoting a play assumed to have occurred when said baseball after being batted comes to rest thereon, wherein, said baseball comprising a thick, weighted disc having a V-groove extending around the circumference of same in the edge thereof, said pitching unit including an elastic member anchored at its ends and adapted to be engaged between its ends in the groove of said baseball, a stop on the board behind said pitching unit, said stop limiting the distance to which the elastic member can be deflected from its normal straight idle position between its ends by said ball in front of the elastic member when the elastic member is seated in the groove of said ball, said stop including a plate that is of substantial width on a line parallel to the elastic member of said pitching unit when the elastic member is in its normal straight idle position, said plate being adjustable away from and toward the elastic member.

5. Baseball game apparatus comprising a board having a substantially flat upper playing surface with a simulated baseball diamond thereon, a bat mounted for turning on said apparatus adjacent home plate by a first player, a baseball in the form of a disc having a flat surface adapted to slide on the playing surface, a pitching unit in center field operated by a second player to drive said baseball on the playing surface toward said bat, fielder units distributed over the playing field to be struck by batted baseballs, designated areas at various locations on the playing field including locations immediately adjacent some of said fielder units denoting a play assumed to have occurred when said baseball after being batted comes to rest thereon, wherein, said baseball comprising a thick, weighted disc having a V-groove extending around the circumference of same in the edge thereof, said pitching unit including an elastic member anchored at its ends and adapted to be engaged between its ends in the groove of said baseball, a stop on the board behind said pitching unit, said stop limiting the distance to which the elastic member can be deflected from its normal straight idle position between its ends by said ball in front of the elastic member when the elastic member is seated in the groove of said ball, said stop including a plate having a long concave ball-engaging edge nearest the elastic member, the edge being in the form of an arc of a circle whose center is on a line that is perpendicular to and that bisects the elastic member when the elastic member is in its idle, straight position, said plate being adjustable away from and toward the elastic member.

6. Baseball game apparatus comprising a board having a substantially flat upper playing surface with a simulated baseball diamond thereon, a bat mounted for turning on said apparatus adjacent home plate by a first player, a baseball in the form of a disc having a flat surface adapted to slide on the playing surface, a pitching unit in center field operated by a second player to drive said baseball on the playing surface toward said bat, fielder units distributed over the playing field to be struck by batted baseballs, designated areas at various locations on the playing field including locations immediately adjacent some of said fielder units denoting a play assumed to have occurred when said baseball after being batted comes to rest thereon, said bat comprising a paddle having a stem that terminates in a disc-like hub whose plane is at right angles to the plane of the paddle and which has a circumferential groove extending around the edge, and further including means for supporting said bat, said supporting means having an axis of rotation eccentric of and perpendicular to the hub for rotative movement about the axis and with the blade standing on edge close to the playing surface of the board and depending from the stem, the stem being disposed substantially on a tangent with respect to the hub, and an elastic member anchored at one of its ends to the board and at its other end on the circumferential edge of the hub near the axis of rotation, said elastic member being disposed so as to engage the groove in the hub.

7. Baseball game apparatus in accordance with claim 6 wherein the stem is high enough above the playing surface of the board to allow said baseball when sliding on the surface of the board to pass underneath the stem when the baseball is so directed.

8. Baseball game apparatus comprising a board having a substantially flat upper playing surface with a simulated baseball diamond thereon, a bat mounted for turning on said apparatus adjacent home plate by a first player, a baseball in the form of a disc having a flat surface adapted to slide on the playing surface, a selectively operable pitching means in a pitching unit in center field operated by a second player to drive said baseball to slide on the playing surface toward said bat at different speeds and to impart selectively a spinning action to cause the baseball to partake different and curved paths along said surface and at different speeds, fielder units distributed over the playing field to be struck by batted and sliding baseballs, and designated areas at various locations on the playing field including locations immediately adjacent some of said fielder units denoting a play assumed to have occurred when said sliding baseball after being batted comes to rest thereon, wherein, said baseball comprising a thick, weighted disc having a V-groove extending around the circumference of same in the edge thereof, said pitching unit including an elastic member anchored at its ends and adapted to be engaged between its ends in the groove of said baseball, a curved wall stop on the board behind said pitching unit, said stop limiting the distance to which the elastic member can be deflected from its normal straight idle position between its ends by said ball in front of the elastic member when the elastic member is seated in the groove of said ball.

* * * * *